United States Patent [19]

Dixon et al.

[11] Patent Number: 4,468,172

[45] Date of Patent: Aug. 28, 1984

[54] JET PUMP PLUG

[75] Inventors: Robert C. Dixon, Morgan Hill; Ronald D. Poland, San Jose; Bradley G. Stoll, San Jose; Bob Y. Okashima, San Jose, all of Calif.

[73] Assignee: General Electric Company, San Jose, Calif.

[21] Appl. No.: 472,870

[22] Filed: Mar. 8, 1983

[51] Int. Cl.[3] ..... F04F 5/00

[52] U.S. Cl. ..... 417/151; 417/176; 417/313; 376/277; 251/299; 239/578

[58] Field of Search ..... 417/54, 55, 151, 160, 417/176, 178, 179, 182, 313; 251/299; 376/277; 239/569, 578

[56] References Cited

U.S. PATENT DOCUMENTS

| | | | |
|---|---|---|---|
| 273,652 | 3/1883 | Wheeler | 417/182 X |
| 1,804,569 | 5/1931 | Taddiken | 417/176 |
| 3,378,456 | 4/1968 | Roberts | 417/179 X |
| 3,838,002 | 9/1974 | Gluntz et al. | 417/151 X |
| 3,927,860 | 12/1975 | Smith et al. | 251/299 |
| 4,043,705 | 8/1977 | Schlosser | 417/151 |

FOREIGN PATENT DOCUMENTS

| | | | |
|---|---|---|---|
| 56-151300 | 11/1981 | Japan | 417/151 |

*Primary Examiner*—William L. Freeh
*Assistant Examiner*—Paul F. Neils
*Attorney, Agent, or Firm*—Ivor J. James, Jr.; Samuel E. Turner; Raymond G. Simkins

[57] ABSTRACT

A jet pump plug for a multi-nozzle jet pump is disclosed wherein the nozzles are accessible through a relatively small opening in the pump structure. The plug comprises a plurality of sections, each including a closure plate and a lever coupled thereto. Each plug section is constructed so as to allow that section to be separately introduced into the opening to the vicinity of the nozzles from a location which may be remote from the pump. The closure plates are manipulated through their attached levers from a remote location to the end of sealing the nozzles with them. The first plug section introduced through the opening includes means for alignment relative to the jet pump structure so as to orient its closure plate with respect to the nozzles. The remaining plug section is supported by the first plug section upon being introduced into the opening. The orientation of the closure plate of the latter plug section relative to the nozzles is effected with reference to the first introduced plug section which serves as a support therefor.

9 Claims, 11 Drawing Figures

JET PUMP PLUG

The present invention relates in general to jet pumps and in particular to a new and improved jet pump plug for sealing the nozzles of a multi-nozzle jet pump.

BACKGROUND OF THE INVENTION

Jet pumps are employed in many different industrial applications, among them to augment the circulation of cooling water in a boiling water reactor. In such an application, external water pumps are used to develop a high velocity water stream which is delivered by several feed pipes to the several jet pumps located within the reactor shell. The nozzles of each jet pump discharge into the throat of a mixer pipe or the like in which the streams of cooling water are intermixed with the heated water present, driving the mixture out through the bottom of the jet pump diffuser and tail pipe.

It is, on occasion, necessary to stop the water circulation to the jet pump in order to open and repair portions of the external circulation pipeing. In order to prevent reactor water from flowing back through the submerged jet pump nozzles and out of the reactor shell, some arrangement is required for positively closing off the pump nozzles in the interior of the reactor.

The problem described above also exists in early jet pump models, however, such pumps generally have only a single nozzle. Although to close off the sole nozzle of such a jet pump in the interior of a reactor still presents a formidable problem, a number of solutions have been worked out, as shown for example by U.S. Pat. No. 4,043,706. As the jet pump art has developed further, single nozzle jet pumps have been joined by multi-nozzle pumps, for example employing a cluster of five nozzles. In such an arrangement, access to the nozzles is restricted due to the required support structure around the nozzle cluster. This limits the working space available and exacerbates the problem of sealing the nozzles.

Further, in a boiling water nuclear reactor, the introduction of a nozzle closing device, and its subsequent manipulation to bring about the desired sealing of the multiple nozzles, must be carried out from a relatively remote location, typically between about 35 and 65 feet above the nozzles.

Finally, not only is access to the nozzle cluster more restricted in a multi-nozzle jet pump, but each closure device, which usually seals more than one nozzle, has an area and a shape that make it more difficult to maneuver around and through the structure of the jet pump.

OBJECTS OF THE INVENTION

It is an object of the present invention to provide a new and improved jet pump plug for closing the multiple nozzles of a jet pump.

It is an additional object of the present invention to provide a new and improved jet pump plug for a multi-nozzle jet pump, which can be quickly and relatively easily introduced to, or removed from, the restricted space around the nozzle cluster.

It is another object of the present invention to provide a jet pump plug for a multi-nozzle jet pump which can be easily and quickly aligned with the pump structure from a remote location.

It is a further object of the present invention to provide a new and improved jet pump plug for a multi-nozzle jet pump which can be readily introduced to the nozzles and oriented relative thereto from a remote location.

It is still another object of the present invention to provide a new and improved jet pump plug for a multi-nozzle jet pump which can be readily manipulated into sealing engagement with the nozzles from a remote location.

SUMMARY OF THE INVENTION

The present invention achieves the foregoing objects by providing apparatus which permits access with relative ease to the multiple nozzles of a jet pump through a restricted opening. The invention permits a plurality of closure devices to be individually inserted into the opening and manipulated from a remote location.

In accordance with the present invention, a plurality of closure plates is employed, each capable of sealing more than one nozzle. The closure plates are separately introduced through the aforesaid opening and they are individually oriented with respect to the nozzles. Thereafter, the closure plates are individually manipulated into sealing engagement with the nozzles. In a preferred embodiment of the invention, two closure plates are used to effect the desired seal of a five-nozzle cluster and apparatus is provided for carrying out the foregoing operations from a location remote from the nozzles.

DETAILED DESCRIPTION OF THE INVENTION

Figure 1:
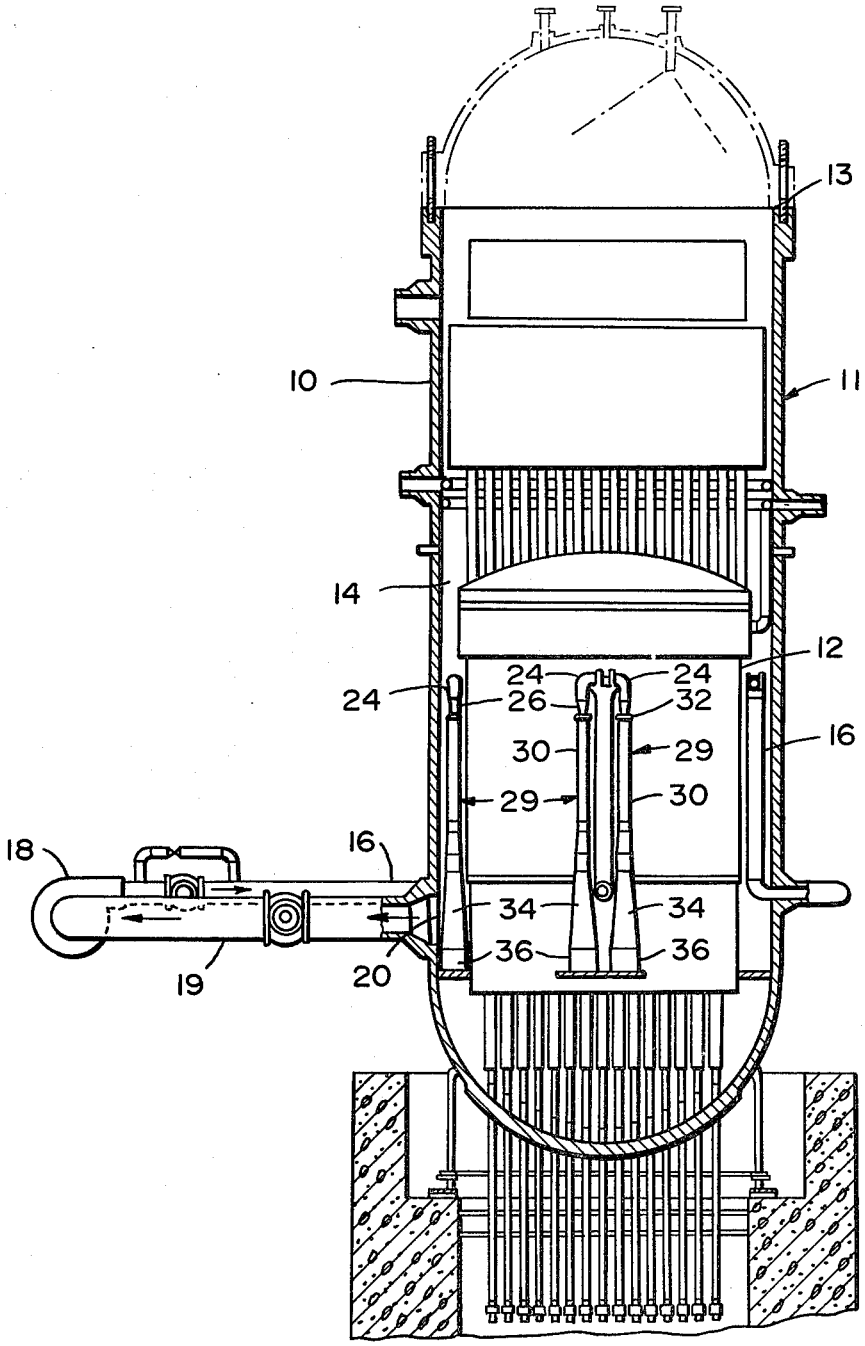
FIG. 1 is a cross-sectional schematic illustration of a nuclear reactor showing the position of a plurality of jet pumps within the reactor shell.

Referring now to the drawings, FIG. 1 illustrates a boiling water nuclear reactor 11, as shown in U.S. Pat. No. 4,043,705, which employs a plurality of jet pumps 29 within the reactor vessel. The pumps are located in an annular gap 14 between reactor core 12 and reactor shell 10. Shell 10 includes an outlet 20 which is coupled to an external circulation pump 18 by way of a pipe 19. External circulation pump 18 is coupled to a plurality of return pipes, sometimes referred to as riser pipes 16 which pass water back through the shell to a plurality of jet pump feed pipes 24. The feed pipes lead directly to nozzles 26, each of which discharges into throats of corresponding jet pump mixer pipes 30 respectively. The latter pipes are followed by jet pump diffusers 34 which are coupled to tail pipes 36 respectively. Each throat is open at the top so as to allow ambient water to be drawn into the mixer pipe.

Figure 2A:
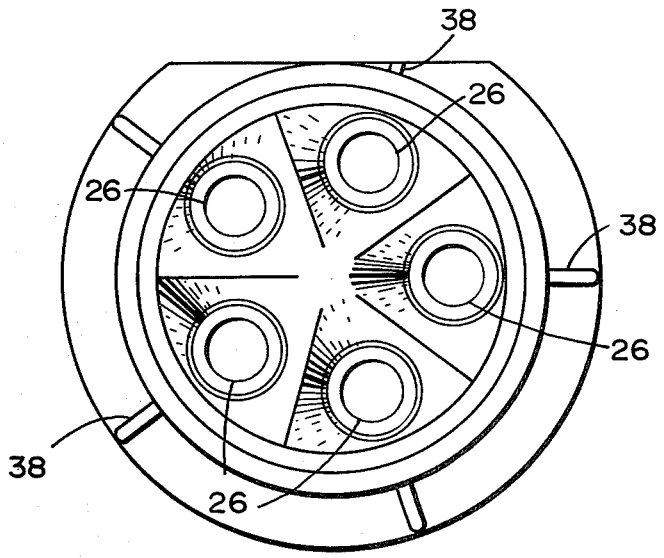
FIG. 2A shows an arrangement of the nozzle cluster of a 5-nozzle jet pump.
Figure 2B:
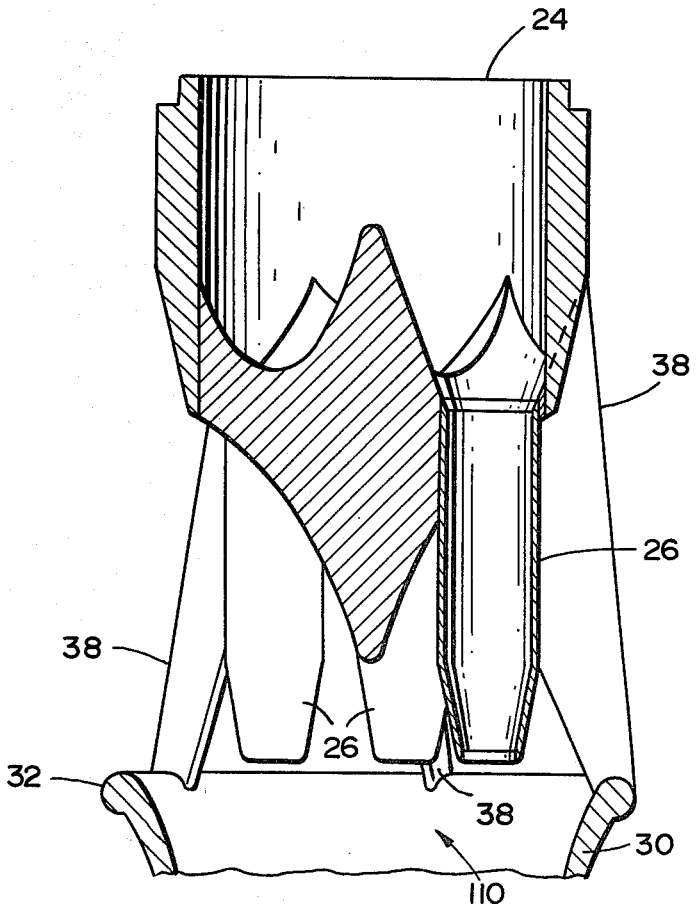
FIG. 2B is a vertical section of the arrangement shown in FIG. 2A.

FIGS. 2A and 2B illustrate a 5-nozzle cluster arrangement as shown, for example, in U.S. Pat. No. 3,838,002, which is assigned to the assignee of the present invention. All five nozzles point downwardly from feed pipe 24 into throat 110 of mixer pipe 30. Mixer pipe 30 terminates in a lip 32 at its upper end. Five successively spaced support ribs 38 connect the feed pipe to lip 32 of the mixer pipe. Each pair of successive support ribs, together with feed pipe 24 and lip 32, defines an opening through which access may be had to the nozzle cluster.

It will be understood that a typical boiling water nuclear reactor of the type shown in FIG. 1 will employ a plurality of jet pumps, each of which may use a 5-nozzle cluster arrangement, as illustrated in FIGS. 2A and 2B. The present invention applies to a jet pump plug for use with a single multiple-nozzle cluster jet pump.

Figure 5A:
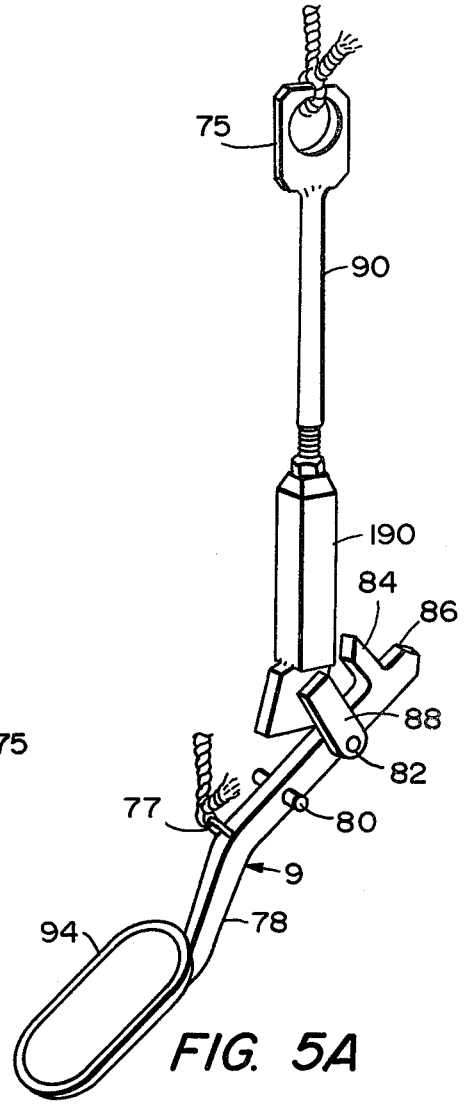
FIG. 5A shows the remaining section of the jet pump plug, which is used together with the first section illustrated in FIGS. 3 and 4.
Figure 5B:
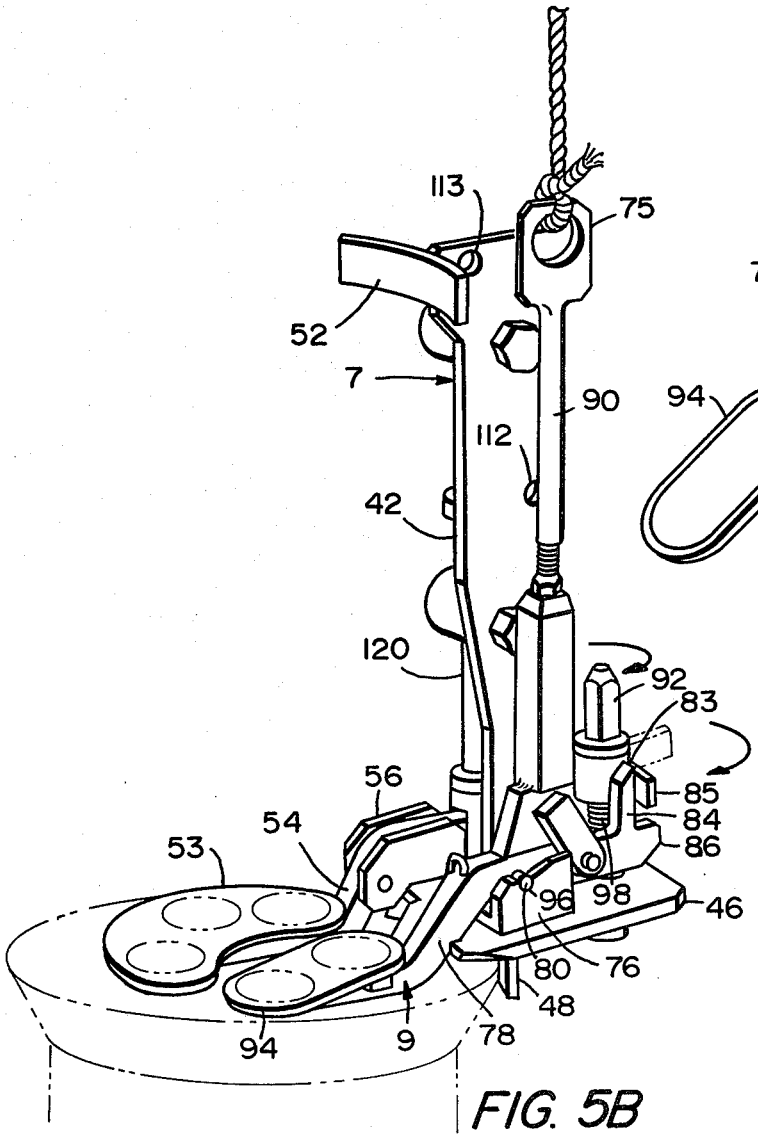
FIG. 5B shows both sections of the jet pump plug in position with respect to each other.
Figure 6:
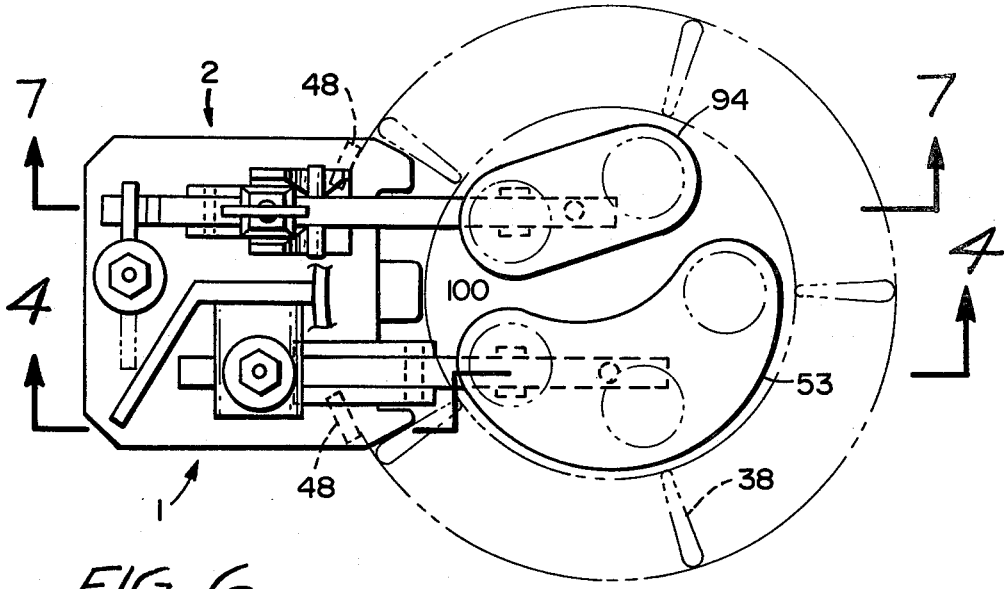
FIG. 6 is a top view of the apparatus of FIG. 5B.

Referring now to FIGS. 3 to 7 of the drawings, a first plug section 7 is seen to comprise a base plate 46 which includes a pair of contact areas 47 in the form of beveled corners. A pair of outside tabs 48 and one interior tab 100 are mounted on the undersurface of the base plate. As best shown in FIG. 6, the tabs are positioned along a semicircle to follow the arc of the underlying lip 32 of mixer pipe 30, which lip is contacted exteriorly by tabs 48 and interiorly by tab 100.

Figure 3:
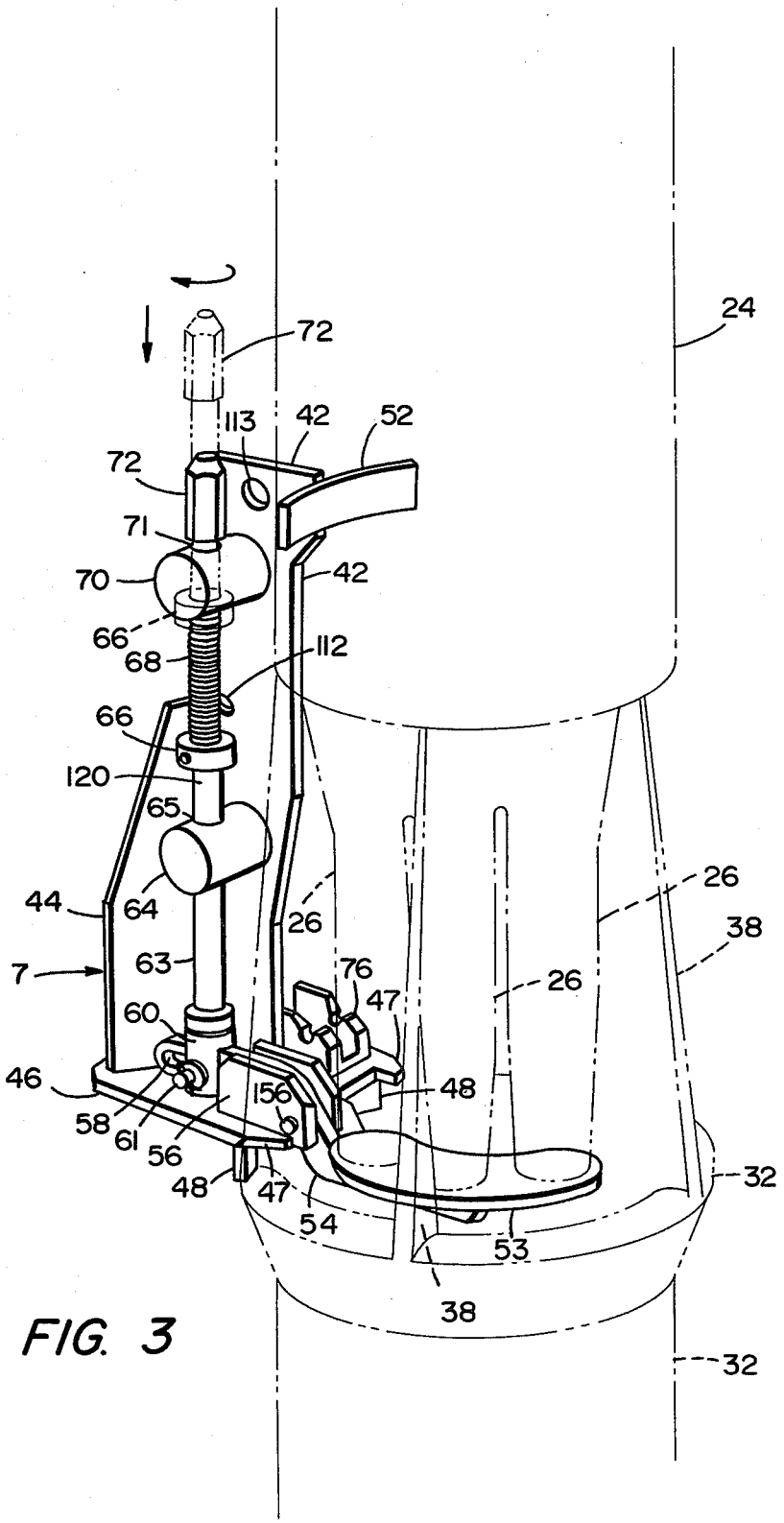
FIG. 3 shows one section of the jet pump plug of the instant invention, in sealing engagement with corresponding nozzles.

A vertical number 42 and a reinforcing gusset 44 are welded to the upper surface of the base plate. Both extend upwardly from the base plate and they are joined along one edge to define an obtuse angle. As best shown in FIG. 3, an arcuate alignment saddle 52 is mounted near the top of the vertical member 42 and adapted to contact feed pipe 24 (indicated in phantom outline) in conforming relationship thereto when plug section 7 is emplaced on the jet pump. The alignment tabs, the beveled base plate and te alignment saddle serve to support and align plug section 7 relative to the jet pump structure.

A pair of holes 112 and 113 in vertical member 42 is located as shown in FIGS. 3 and 5B. A pair of ropes, omitted from the drawings for the sake of clarity of illustration, may be threaded through these holes to provide means by which the first plug section may be suspended and maneuvered for insertion into a selected opening of the jet pump structure. Holes 112 and 113 are spaced from one another both vertically and horizontally to provide for greater maneuverability of the plug section.

Plug section 7 further includes closure means for closing off designated nozzles 26 of the 5-nozzle cluster. The closure means includes a crescent-shaped closure plate 53 which is adapted to be brought into sealing engagement with three of the aforesaid nozzles. Base plate 46 supports a fulcrum 56 which comprises two parallel metal flanges extending upwardly from the base plate and a pivot rod 156 extending therebetween. The fulcrum and the pivot rod serve to orient the closure plate with respect to the three nozzles which are to be closed off, while lever 54 serves to manipulate the closure plate into sealing engagement with the nozzles.

The closure means further comprises an inverted jack screw 120 mounted to vertical member 42 by means of upper and lower connecting members 70 and 64 respectively, which are pierced by mutually aligned bores 71 and 65 respectively. Bore 71 is threaded and engages the threaded upper portion 68 of jack screw 120. The jack screw further includes a hex nut 72 attached to upper portion 68. Bore 65 of lower connecting member 64 acts as a non-threaded guide for the lower portion 63 of the jack screw.

Figure 4:
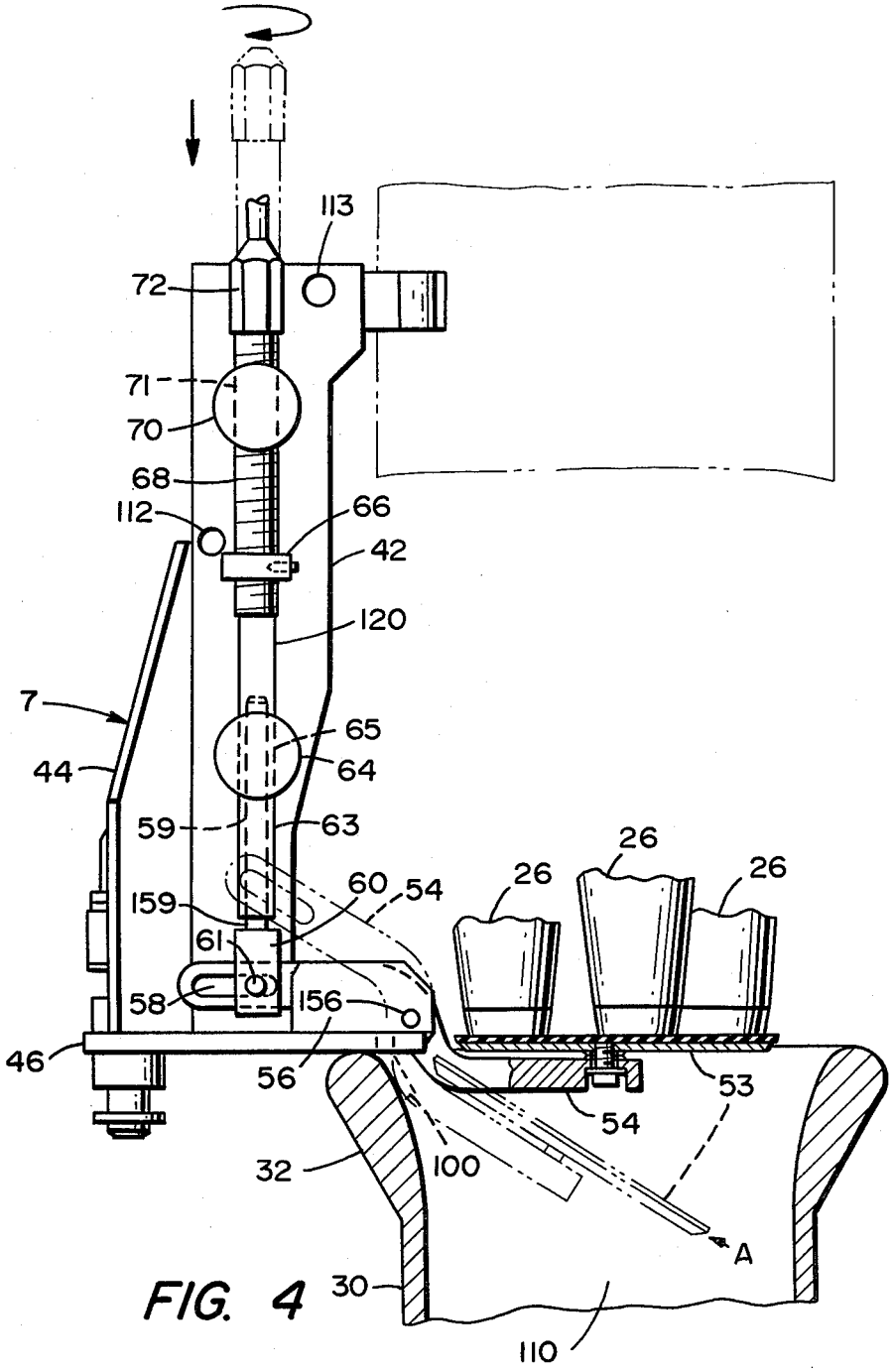
FIG. 4 provides another perspective of the apparatus in FIG. 3, showing the closure plate in both engaged and released positions.

As shown in FIG. 4, jack screw 120 further includes a collar 66 which acts as a stop to prevent the jack screw from being withdrawn through upper connecting member 70. The lower portion 63 of jack screw 120 defines a bore 59 which slidably includes a smooth bayonet 159 mounted on a clevis 60. Clevis 60 includes a transverse pin 61 which rides in a cam groove 58 of lever 54.

The second plug section 9 is illustrated in FIGS. 5A and 5B. A suspension rod 90 terminates at one end in a suspension ring 75 to which a rope may be attached, as shown. The opposite end of suspension rod 90 terminates in a weighted extension member 190. Plug section 9 includes a lever 78 which is pivotally mounted to extension member 190 by means of a pivot pin 82. Pin 82 extends between two metal flange plates 88 and 89 which depend from the weighted extension member. One end of the lever 78 is movably coupled to a closure plate 94 which is adapted to engage the remaining two nozzles of the 5-nozzle cluster. The opposite end of lever 78 terminates in a lever extension 86 near which a lever stop 84 is located. A pivot rod 80 is mounted through lever 78 between pivot pin 82 and closure plate 94. A suspension ring 77 is affixed directly to lever 78, between pivot rod 80 and closure plate 94 and is likewise adapted to receive a rope.

As best shown in FIGS. 3 and 5B, an upwardly open fulcrum 76 is disposed on base plate 46 and includes a cradle 96 adapted to receive pivot rod 80. Fulcrum 76 acting through lever 78, serves to align second plug section 9 with respect to first plug section 7 and to orient closure plate 94 with respect to its corresponding nozzles.

Figure 5C:
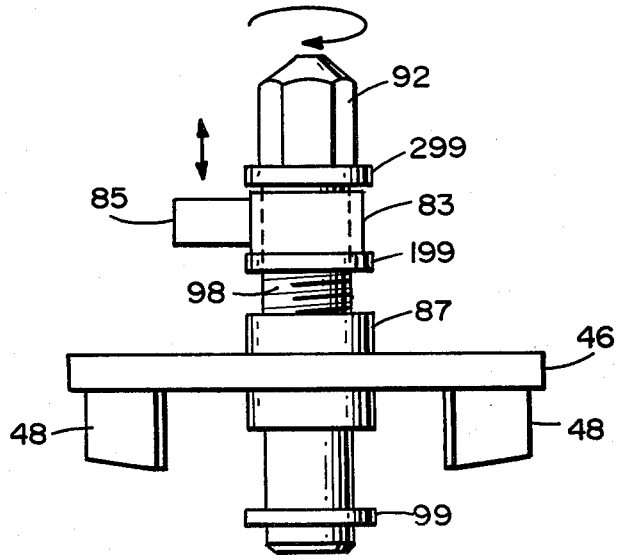
FIG. 5C illustrates the actuating mechanism of the second plug section in greater detail.
Figure 7:
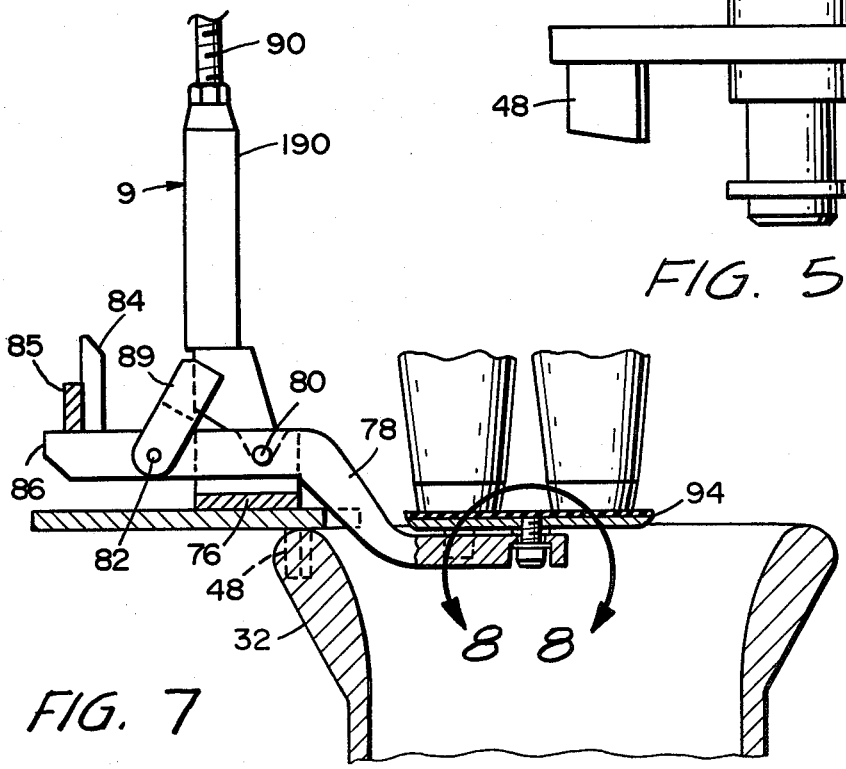
FIG. 7 is a partial cross-sectional view of the second plug section in sealing engagement with corresponding nozzles.

The actuating mechanism of the second plug section, which is partly illustrated in FIG. 5B, is shown in greater detail in FIG. 5C. An actuating screw 98 mates with a threaded sleeve 87 which is mounted in a bore through base plate 46. A retainer ring 99 is welded to screw 98 below sleeve 87. A second retainer ring 199 is welded to screw 98 above sleeve 87 a sufficient distance apart to permit the screw freedom of motion. A collar 83 is movably disposed on a smooth portion of screw 98 above retainer ring 199 and includes an actuating tab 85. A third retainer ring 299 is welded to screw 98 above collar 83 and is surmounted by a hex nut 92. Upon rotation of screw 98 by means of hex nut 92, tab 85 will contact lever stop 84. This action prevents tab 85 from rotating further and positions it over lever extension 86. Further travel of screw 98 in a downward direction will guide the tab downwardly against the lever extension 86. This action manipulates closure plate 94 into close sealing engagement with the appropriate nozzles.

Figure 8:
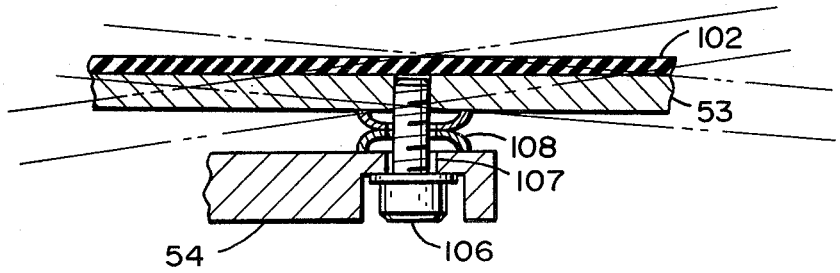
FIG. 8 is a cross-sectional detail view of the mounting of a closure plate, which is applicable to both sections of the jet pump plug.

FIG. 8 illustrates in detail the movable coupling between a closure plate and its corresponding lever, e.g., between closure plate 53 and lever 54. The coupling is adapted to allow the closure plate translational freedom of movement in an up-down direction and freedom to pivot with respect to the lever. Bolt 106 rigidly engages closure plate 53 through a cone shaped bore 107 in lever 54. Disposed between the lever and the closure plate is a spring washer 108, which surrounds bolt 106. Thus, any downward pressure on the center of the closure plate will displace bolt 106 (and thus closure plate 53) in a downward direction with respect to lever 54. Similarly, an off-center downward force on the closure plate will deflect bolt 106 from its normal position at right angles with respect to lever 54. The closure plate itself is preferably covered with a replaceable elastic sheet 102 to provide a yielding surface for making contact with nozzles.

In operation, the jet pump plug which is the subject matter of the present invention is introduced to the nozzle cluster of the jet pump in separate plug sections. During this procedure the jet pump is preferably not in operation. As previously explained, the cluster of nozzles which are to be closed may be located within a nuclear reactor similar to the one shown in FIG. 1. The water level within the vessel is well below the upper edge of flange 13. The operator charged with maneuvering the plug into position on the jet pump will be standing on supports above the water level, typically between about 35 and 65 feet above the selected opening through which the jet pump is to be introduced. During this procedure, the operator will be assisted by a technician operating an underwater televison camera to help the operator guide the plug sections into place.

The first plug section, i.e., plug section 7, is preferably suspended by at least two nylon ropes respectively attached to vertical member 42 through holes 112 and 113. In order to insert the plug section into the selected opening, it is first lowered by its ropes through annular gap 14 between reactor shell 10 and reactor core 12, shown in FIG. 1, to the vicinity of the selected opening. The opening, as described above, is defined by the lower rim of feed pipe 24, by mixer lip 32 and by a pair of successive support ribs 38, an area which is typically 7 inches in height and $3\frac{3}{4}$ inches wide. However, the vertical height of the space into which each closure plate must be maneuvered is measured between the rim of nozzles 26 and lip 32 and is typically of the order of 1 inch. The ropes are used to rotate plug section 7 into place and to tip the plug section forward so that the closure plate 53 enters the opening of the pump structure and extends into throat 110 of mixer pipe 30.

After the closure plate has passed between the pair of support ribs 38 which define the selected opening, beveled contact areas 47 of ase plate 46 will abut against the support ribs, thus centering the base plate 46 in its selected opening. Additionally, tabs 48 and 100 will engage the lip of the mixer, both exteriorly and interiorly, while the arcuate alignment saddle 52 makes contact with the nozzle feed pipe 24 and thereby completes the alignment of plug part 7 with the jet pump structure. Since the closed fulcrum 56, which determines the orientation of crescent-shaped closure plage 53, is affixed to base plate 46, the alignment of plug section 7 also serves to position closure plate 53 at its corresponding nozzles 26.

Next, the operator will apply a socket wrench, e.g., affixed at the end of a pole, to engage and rotate hex nut 72. As the hex nut rotates, jack screw 120 will travel in a downward direction and bear down on bayonet 159. As the bayonet is forced downward, the pin of clevis 60 slides in cam groove 58, while forcing lever 54 to turn about pivot rod 156. This brings closure plate 53 into sealing contact with three of the nozzles of the jet pump. The counterforce developed against the closure plate forces the base plate, via fulcrum 56, against lip 32. The interaction of these two forces tends to urge alignment saddle 52 against feed pipe 24, and to press tab 100 against the interior of lip 32. This locks the plug section 7 into position with respect to the jet pump, with closure plate 53 in sealing engagement with three nozzles of the 5-nozzle cluster.

At this point, the second plug section 9 is suspended by two ropes as shown in FIG. 5A and is lowered through annular gap 14 toward the selected opening in the jet pump structure. By suitably maneuvering plug section 9, closure plate 94 is inserted through the opening and lowered until pivot rod 80 rests in cradle 96 of open fulcrum 76. Fulcrum 76 serves to align plug section 9 with respect to plug section 7 and to orient closure plate 94 with respect to the nozzles which remain to be closed by this plate. The weight of suspension rod 90, acting on lever 78 and on one side of pivot rod 80, rotates the closure plate into contact with the nozzles.

Hex nut 92 can now be engaged and rotated by a socket wrench carried on a pole, as before. This action brings tab 85 into contact with stop 84 of lever 78. Further rotation of hex nut 92 causes tab 85 to contact lever extension 86 and causes the lever to rotate further around pivot rod 80. The closure plate is thus manipulated against the nozzles to complete the seal.

The foregoing operation is repeated for each jet pump coupled to a given external circulation pump 18. Typically this may involve plugging some 20 jet pumps.

With all nozzles now sealed, the external circulation piping can be opened and drained. This action removes the water from return pipe 16 and from feed pipe 24 directly above the nozzle cluster under consideration. Since, as mentioned above, the nozzles are submerged in water inside the reactor, a substantial degree of hydrostatic pressure will develop at the bottom of each closure plate to reinforce the seal between the closure plates and the outlet nozzles.

Following the necessary work on the external circulation piping 16, 19 and on the external circulation pump 18, normal operation of the reactor may resume. This calls for the removal of the jet pump plug, which is initiated by releasing the pressure applied to the respective closure plates by jack screw 120 and screw 98. This is effected by rotating the respective hex nuts in the opposite direction so as to free levers 54 and 78 for rotation about their respective pivots. External circulation pump 18 is now turned on to drive water into return pipe 16 and to equalize pressure between the interior of the nozzles and the interior of the reactor vessel. Closure plate 94 will separate readily from the nozzles as tension is first applied to suspension ring 75. Plug section 9 is then maneuvered out of the opening and is lifted by the ropes attached to suspension rings 75 and 77. Closure plate 53 separates readily from its respective nozzles, in part due to its own weight, allowing plug section 7 to be removed from the opening and to be lifted. After removal of all the jet pump plugs, the reactor may be sealed and returned to normal service.

In the exemplary embodiment of the invention as set forth in the specification and shown in FIGS. 3 through 8, a 5-nozzle cluster of a jet pump is sealed. It will be readily apparent that the invention may be adapted to closing off a different type of nozzle clusters, varying both in the number of nozzles and in their arrangement. Various other modifications may also be made, e.g., variations in the size and shape of the closure plates, in the type of the sealing mechanism, in the fulcrum structures and in the actuating mechanisms for the respective plug sections. For example, the closure plates may be altered so that instead of flat plates, a modified plate with protrusions corresponding to the arrangement of nozzles may be used. This adaption would aid in orienting the plate to the nozzles. In addition, a weight could be substituted for the jacking screw in the first plug section to cause the corresponding closure plate to be rotated into sealing engagement with the appropriate nozzles.

While certain embodiments of the present invention have been disclosed herein, it will be clear that numerous modifications, variations, changes, full and partial equivalents will now occur to persons skilled in the art without departing from the spirit and scope of the invention. Accordingly, it is intended that the invention be limited only by the spirit and scope of the appended claims.

What is claimed is:

1. A jet pump plug for sealing off a multi-nozzle jet pump, the nozzles of said jet pump being clustered such that access to the nozzle cluster is available through a selected one of a plurality of openings in the structure of said jet pump:

said jet pump plug comprising:

at least first and second plug sections including means for closing off said nozzles;

means for partially inserting said plug sections in sequence through said selected opening to bring the corresponding closure means to the vicinity of said nozzles;

means for orienting said closure means of said inserted first plug section relative to said nozzles including means for aligning said first plug section with respect to said pump structure;

means for orienting said closure means of said inserted second plug section relative to said nozzles including means for aligning said second plug section with respect to said first plug section; and means for separately manipulating said oriented closure means to bring them into sealing relationship with said nozzles.

2. A jet pump plug as set forth in claim 1 wherein said means for aligning said second plug section with respect to said first plug section includes means for removably linking said second plug section to said first plug section upon partial insertion of said second plug section through said opening.

3. A jet pump plug as set forth in claim 1 wherein each of said manipulating means includes a lever movably coupled to a corresponding closure means;

said means for aligning said first plug section including a fixed base plate adapted to be aligned with respect to said pump structure;

said means for aligning said second plug section including an open fulcrum mounted on said base plate, and a pivot rod carried by said lever of said second plug section, said open fulcrum being adapted to removably receive said pivot rod upon partial insertion of said second plug section into said opening.

4. A jet pump plug as set forth in claim 1 wherein said first plug section includes a support adapted to engage said pump structure when said first plug section is partially inserted through said opening; and said means for aligning said first plug section relative to said pump structure including means for aligning said support with respect to said pump structure.

5. A jet pump plug as set forth in claim 1 or 4 and further including means for operating said inserting and manipulating means respectively from a location remote from said selected opening.

6. A jet pump plug for sealing off a multi-nozzle jet pump, the nozzles of said jet pump being clustered such that access to the nozzle cluster is available through a selected one of a plurality of openings in the structure of said jet pump;

said jet pump plug comprising:

at least first and second plug sections including means for closing off said nozzles, said closure means comprising a closure plate having at least one face thereof coated with an elastic material, each of said coated faces being adapted to engage at least one of said nozzles in sealing relationship;

means for partially inserting said plug sections in sequence through said selected opening to bring the corresponding closure means to the vicinity of said nozzles;

means for separately orienting the closure means of each of said inserted plug sections relative to said nozzles;

means for separately manipulating said oriented closure means to bring them into sealing relationship with said nozzles, said manipulating means including a separate lever corresponding to each of said closure plates; and means for movably coupling each of said levers to its corresponding closure plate.

7. A jet pump plug as set forth in claim 6 wherein said jet pump cluster includes five nozzles; and wherein said closure plates of said first and second plug sections are adapted to engage three and two nozzles respectively of said cluster in sealing relationship.

8. A jet pump plug comprising at least first and second plug sections for sealing off a multi-nozzle jet pump, the nozzles of said jet pump being clustered and extending downwardly from a feed pipe toward the throat of a mixer pipe, the nozzle cluster being accessible through a selected one of a plurality of openings in the jet pump structure each defined by said feed pipe, by the lip of said mixer pipe and by connecting ribs successively spaced therebetween;

said first plug section comprising:

a base plate;

a vertical member rising from said base plate and affixed thereto;

means for aligning said first plug section with respect to the structure of said jet pump, said alignment means including a pair of contact areas on said base plate configured to abut a pair of said successively spaced ribs, a plurality of tabs projecting downwardly from said base plate positioned to engage said lip, and a saddle affixed to said vertical member configured to contact said feed pipe in conforming relationship;

first nozzle closure means including a first closure plate adapted to close off a plurality of said nozzles, and a first lever movably coupled at one end thereof to said first closure plate;

means for partially inserting said first plug section into a selected one of said openings, said inserting means including means for maneuvering said first closure plate into said selected opening and to maneuver said contact areas, said tabs and said saddle respectively into contact with said jet pump structure;

means for orienting said inserted first closure plate relative to said plurality of nozzles including a closed fulcrum affixed to said base plate and having said first lever movably mounted thereof;

said first nozzle closure means further including a jackscrew mounted to said vertical member and coupled to the opposite end of said first lever, and means for turning said jackscrew to ring said first closure plate into sealing engagement with said plurality of nozzles by pivoting said first lever about said closed fulcrum;

said second plug section comprising:

second nozzle closure means including a second closure plate adapted to close off the remaining ones of said nozzles, and a second lever movably coupled at one end thereof to said second closure plate;

means for orienting said second closure plate relative to said remaining nozzles including an upwardly opening fulcrum mounted on said base plate, a pivot pin affixed to said second lever intermediate the opposite end thereof and said closure plate and adapted to engage said open fulcrum;

means for partially inserting said second plug section into said selected opening, said last-recited inserting means including a suspension rod pivotably coupled at its lower end to said second lever intermediate said opposite lever end and said pivot pin, and means attached to said second lever and to said suspension rod for maneuvering said second closure plate into said selected opening, for maneuvering said pivot pin into said open fulcrum and for bringing said second closure plate toward said remaining nozzles; and said second nozzle closure means further including actuating means threadedly engaging said base plate and adapted to be raised or lowered relative thereto, said actuating means being adapted to bear against said opposite end of said second lever, and means for rotating said actuating means to bring said second closure plate into sealing engagement with said remaining nozzles by exerting pressure with said actuating means against said opposite end of said second lever.

9. Apparatus in accordance with claim 8 wherein said contact areas on said base plate include a pair of beveled plate corners;

said means for maneuvering said first plug section including a first pair of ropes extending from a remote location above said nozzles and attached at mutually spaced points to said vertical member;

said means for maneuvering said second plug section including a second pair of ropes extending from said remote location, one of said second pair of ropes being attached to said second lever intermediate said pivot pin and said second closure plate, and the other one of said second pair of ropes being attached to the upper end of said suspension rod;

said jackscrew and said actuating means each terminating in a nut at its upper end; and said means for rotating said jackscrew and said actuating means respectively including each of said nuts.

* * * * *